US007328679B2

(12) United States Patent
Ihara et al.

(10) Patent No.: US 7,328,679 B2
(45) Date of Patent: Feb. 12, 2008

(54) VALVE GUIDE STRUCTURE

(75) Inventors: Yoshiki Ihara, Hino (JP); Shinya Nitta, Hino (JP)

(73) Assignee: Hino Motors, Ltd., Hino-shi (JP)

( * ) Notice: Subject to any disclaimer, the term of this patent is extended or adjusted under 35 U.S.C. 154(b) by 0 days.

(21) Appl. No.: 10/576,022

(22) PCT Filed: Aug. 3, 2004

(86) PCT No.: PCT/JP2004/011078

§ 371 (c)(1),
(2), (4) Date: Apr. 17, 2006

(87) PCT Pub. No.: WO2005/038200

PCT Pub. Date: Apr. 28, 2005

(65) Prior Publication Data

US 2007/0017475 A1 Jan. 25, 2007

(30) Foreign Application Priority Data

Oct. 21, 2003 (JP) ..... 2003-360502

(51) Int. Cl.
*F01L 3/08* (2006.01)

(52) U.S. Cl. ..... 123/188.9; 123/188.6

(58) Field of Classification Search ..... 123/188.9, 123/188.6

See application file for complete search history.

(56) References Cited

U.S. PATENT DOCUMENTS 3,699,942 A * 10/1972 Moray ..... 123/188.6
3,828,756 A * 8/1974 Kammeraad et al. .... 123/188.9
4,124,220 A * 11/1978 Leone et al. ..... 277/502
5,564,187 A * 10/1996 Sihon ..... 29/888.41
5,632,240 A * 5/1997 Sihon ..... 123/188.9
6,125,810 A * 10/2000 Haselkorn ..... 123/188.9
6,394,463 B1 * 5/2002 Otani ..... 277/502

FOREIGN PATENT DOCUMENTS

JP 120305/81 9/1981
JP 017083/1980 * 12/1981
JP 60-032914 2/1985
JP 64-36505 3/1989
JP 07-034816 2/1995

* cited by examiner

*Primary Examiner*—Stephen K. Cronin
*Assistant Examiner*—Jason Benton
(74) *Attorney, Agent, or Firm*—Oblon, Spivak, McClelland, Maier & Neustadt, P.C.

(57) ABSTRACT

A valve guide structure is provided which can suppress deterioration of a valve guide even if radial stress is applied on an upper portion of a stem of a valve.

The valve guide structure is such that the stem 2 of the valve 1 is supported by an inner peripheral surface of the valve guide 16 to restrict moving directions of the valve 1. A recess 18 is formed on an inner peripheral surface of the valve guide 16 and extends downwardly from an upper end of the valve guide 16 along the stem 2 of the valve 1 so as to provide a clearance between the valve guide 16 and the stem 2 of the valve 1.

4 Claims, 5 Drawing Sheets

VALVE GUIDE STRUCTURE

TECHNICAL FIELD

The present invention relates to a valve guide structure for supporting a stem of a valve through a valve guide.

BACKGROUND ART

FIGS. 1 and 2 are schematic views showing a whole and particulars of a conventional valve guide structure, respectively.

Generally, a valve 1 of an engine has a vertically extending stem 2 pinched and supported by an inner peripheral surface 4 of a sleeve-like valve guide 3. Arranged on an upper end of the stem 2 via a cross head 5 is a rocker arm 6 so as to transmit vertical motions to the valve 1.

The cross head 5 has a guide pin 7 arranged substantially centrally on the head 5 to restrict movements of the rocker arm 6 to the valve 1 to vertical directions. The valve guide 3 in support of the valve 1 is fixed to a cylinder head 8 to further restrict the moving directions of the valve 1 to the vertical directions.

An outer peripheral surface of the valve guide 3 is formed, at its upper portion, with a smaller-diameter outer peripheral surface 9 for arrangement having an annular engagement groove 10 on the surface 9. The peripheral surface 9 and the engagement groove 10 are engaged with a cylindrical stem seal 11 which in turn has at its top a closed portion 12 in abutment with the stem 2 of the valve 1 and a spring 13 for tightening the closed portion 12 to prevent intrusion of oil. In the figures, reference numeral 14 denotes valve springs urging the valve 1 into a closed direction; and 15, a portion for engagement with the springs 14.

Recently, the whole structure including the valve guide 3 is such that the guide pin 7 is omitted for cost reduction and in view of shapes of for example the cross head 5 and stem seal 11.

When the engine is driven, one end of the rocker arm 6 is pushed upward by a push rod (not shown) during exhaust stroke of the engine and at the same time the other end of the arm 6 is pushed down to open the valve 1 via the cross head 5 to thereby discharge the exhaust gas from a combustion chamber (not shown).

In this connection, typical structures of the valve guide are shown by some patent publications (see, for example, Reference 1).

[Reference 1] JP 7-34816A

SUMMARY OF THE INVENTION

Problems to be Solved by the Invention

However, when the engine is driven with the guide pin 7 omitted, thrust force acts on the cross head 5 to apply radial stress on an upper portion of the stem 2 of the valve 1 so that load working point P is generated on an upper end of the valve guide 3, resulting in a problem of early deterioration of the guide 3.

The invention was made in view of the above and has its object to provide a valve guide structure which can suppress the deterioration of the valve guide even when the radial stress is applied on the upper portion of the stem of the valve.

Means of Measure for Solving The Problems

The invention is directed to a valve guide structure for supporting a stem of a valve by an inner peripheral surface of a valve guide so as to restrict moving directions of the valve, comprising a recess on an inner peripheral surface of the valve guide, said recess extending downwardly from an upper end of the valve guide along the stem of the valve so as to form a clearance between the valve guide and the stem of the valve.

The recess on the valve guide may have a lower end lower in position than a thinnest portion of the valve guide.

An outer periphery of the valve guide may be formed with an engagement groove so as to be engaged with a stem seal for prevention of intrusion of oil, the lower end of the recess on the valve guide being lower in position than the engagement groove.

The recess may have a taper with a reduced inner diameter toward the lower end of the recess.

Thus, according to the invention, a recess is formed on an inner peripheral surface of a valve guide to provide a clearance between a valve guide and a stem of a valve so that, even if radial stress is applied to the stem of the valve, load working point generated on the valve guide can be positioned at a lower end of the recess and an annular portion of the valve guide above the load working point can provide a reinforcing member, thereby suppressing deterioration of the valve guide.

When the recess on the valve guide is formed with its lower end being lower in position than a thinnest portion of the valve guide, the load working point is generated at a position lower than the thinnest portion of the valve guide, which can prevent the load from acting on the thinnest portion of the valve guide and favorably suppress the deterioration of the valve guide.

When an engagement groove is formed on an outer periphery of the valve guide so as to engage with a stem seal for prevention of intrusion of oil and the recess on the valve guide is formed with its lower end being lower in position than the engagement groove, then load working point is generated at a position lower than the engagement groove, which can prevent the load from acting on the engagement groove and favorably suppress the deterioration of the valve guide.

When the recess has a taper with a reduced inner diameter toward its lower end, the load generated on the valve guide is relieved by the taper, which can further favorably suppress the deterioration of the valve guide.

Effects of the Invention

A valve guide structure according to the invention can exhibit an excellent effect that deterioration of the valve guide can be suppressed even if radial stress acts on an upper portion of a stem of a valve.

EXPLANATION OF THE REFERENCE NUMERALS

Figure 1:
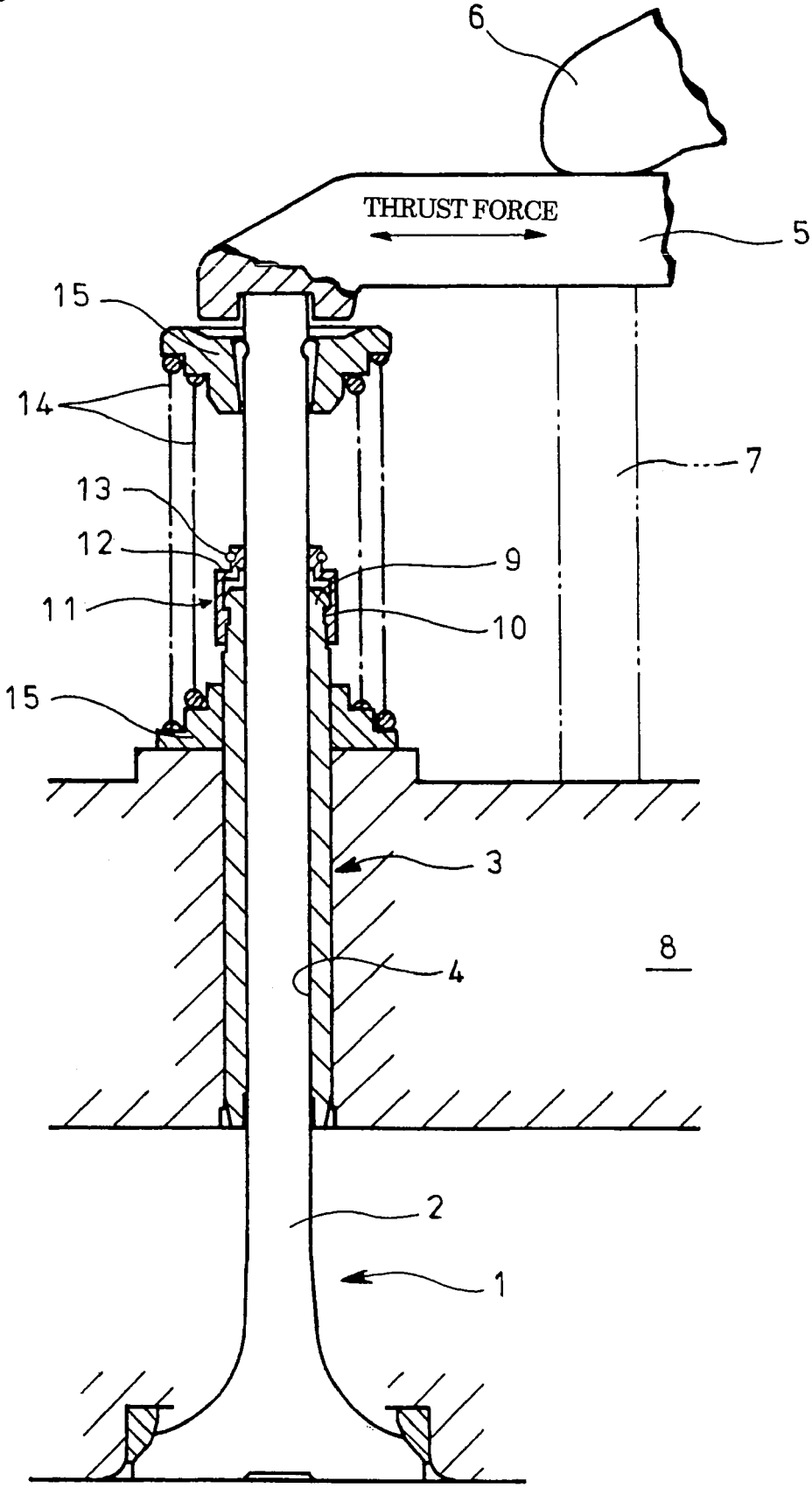
FIG. 1 A schematic view showing a whole of a conventional valve guide structure.

1 valve
2 stem
10 engagement groove
16 valve guide
17 inner peripheral surface
18 recess
19 taper
20 taper
P working point

BEST MODE FOR CARRYING OUT THE INVENTION

First an embodiment of the invention will be described in conjunction with the drawings.

Figure 2:
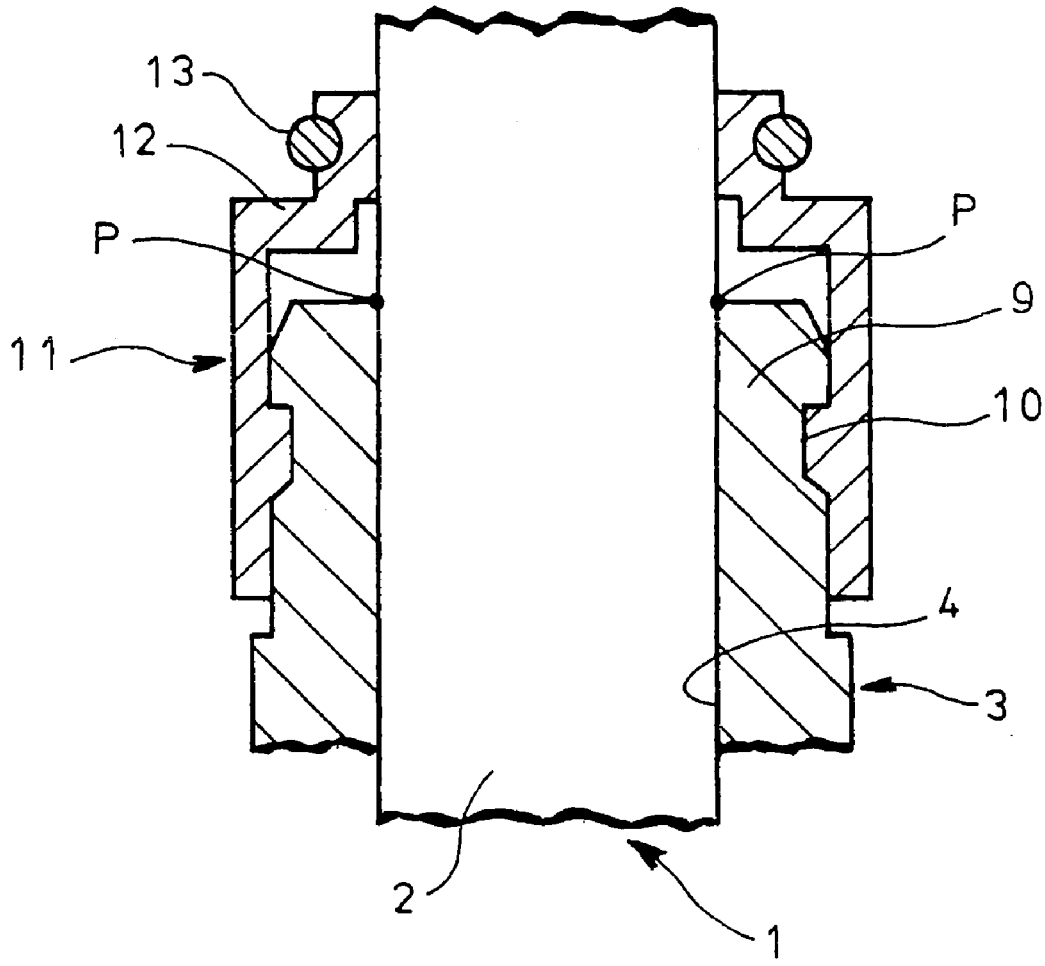
FIG. 2 A schematic view showing particulars of the conventional valve guide structure.
Figure 3:
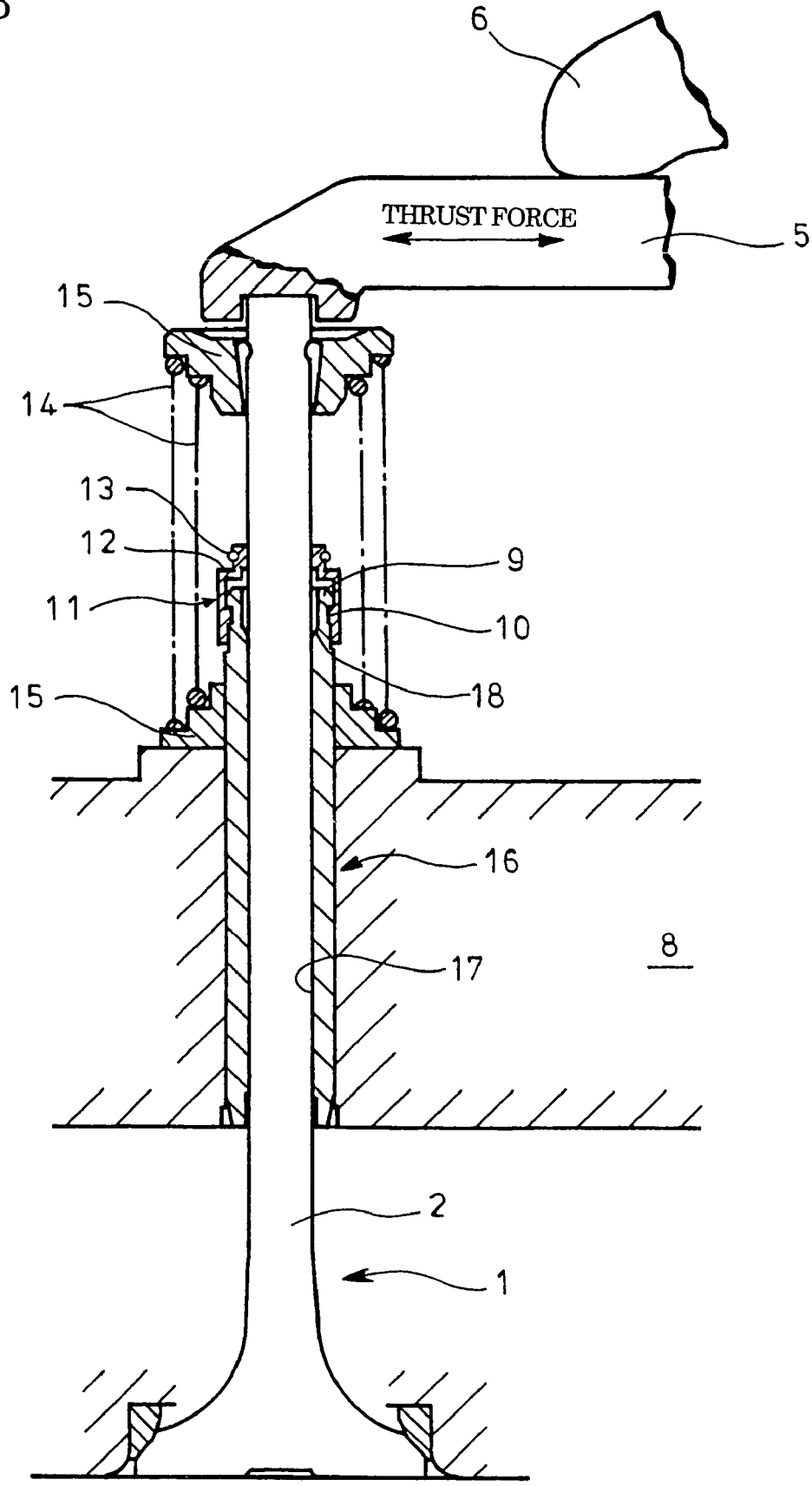
FIG. 3 A side view showing a whole of a valve guide structure according to an embodiment of the invention.
Figure 4:
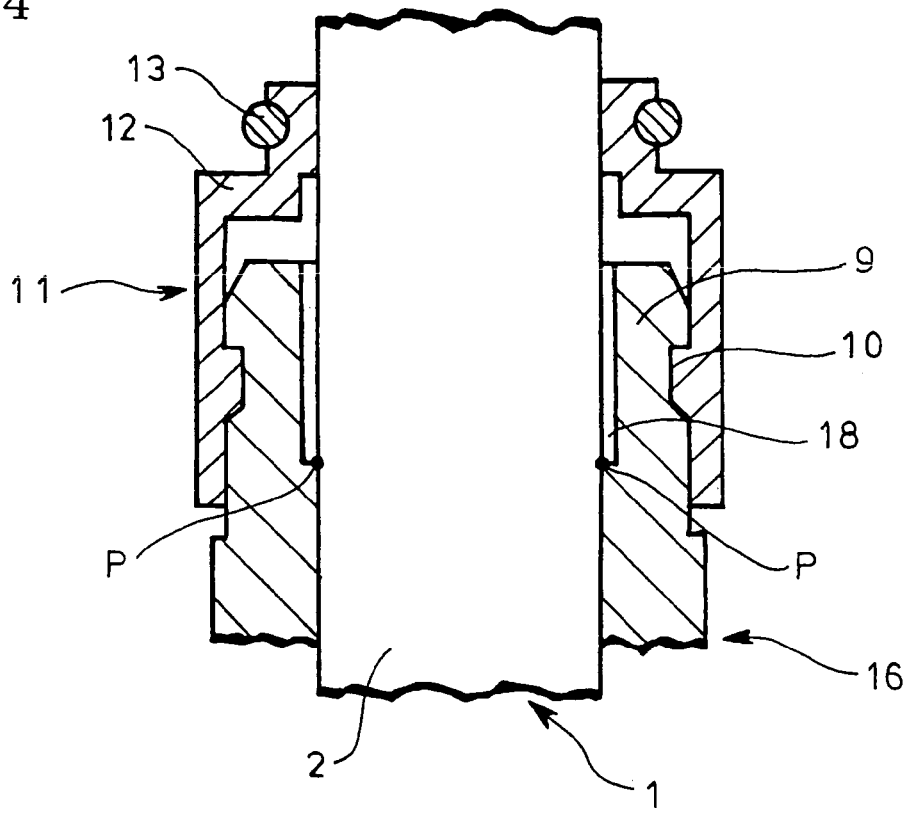
FIG. 4 A schematic view showing particulars of the wave guide structure.
Figure 5:
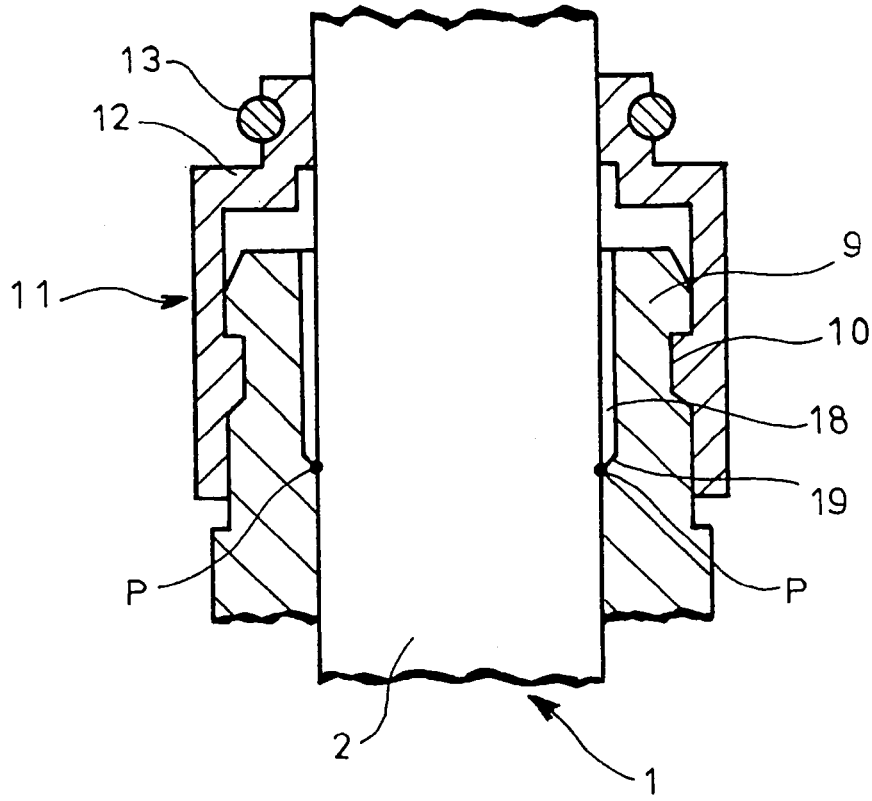
FIG. 5 A schematic view showing particulars of a further valve guide structure according to the invention.
Figure 6:
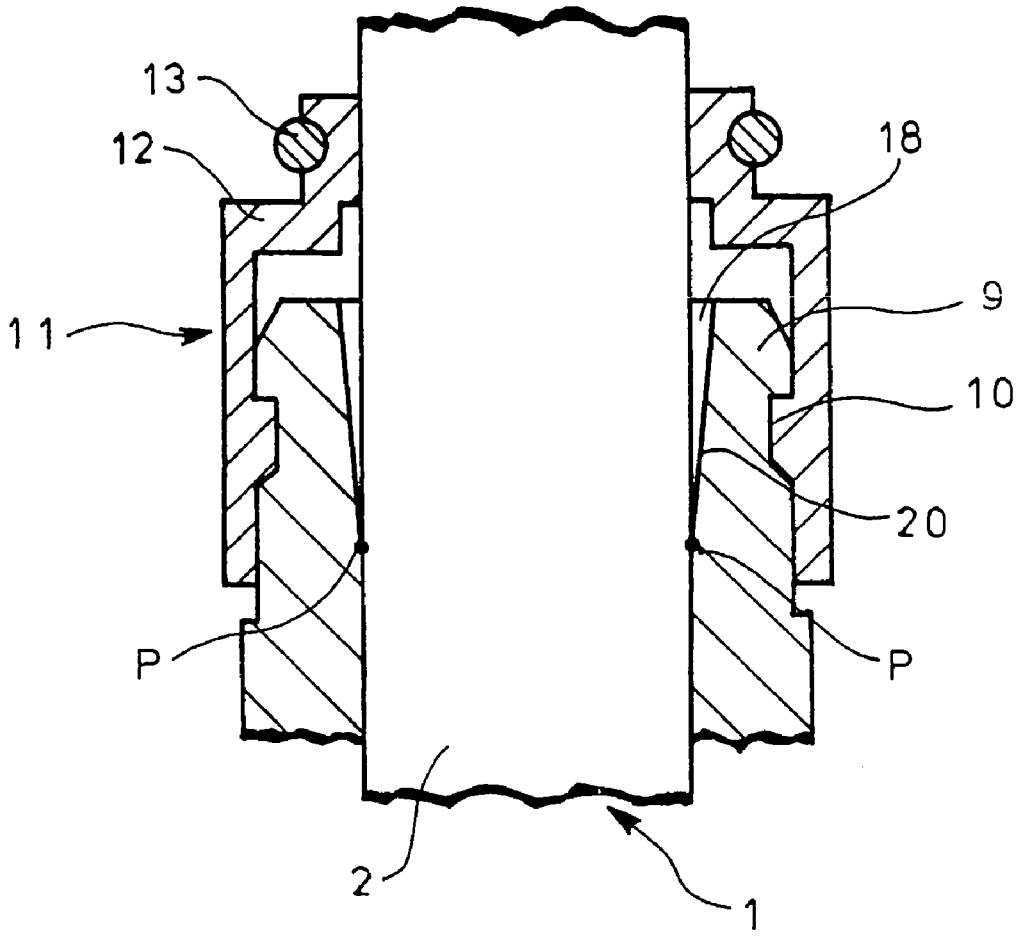
FIG. 6 A schematic view showing particulars of a still further valve guide structure according to the invention.

FIG. 3 is a side view showing a whole of a valve guide structure according to the embodiment of the invention; FIG. 4 is a schematic view showing particulars of the valve guide structure; FIG. 5 is a schematic view showing particulars of a further valve guide structure according to the invention; and FIG. 6 is a schematic view showing particulars of a still further valve guide structure according to the invention. In the figures, parts same as those shown in FIGS. 1 and 2 are represented by the same reference numerals.

A valve guide structure according to an embodiment is provided with a recess 18 on an inner peripheral surface 17 of a valve guide 16 which extends with a constant width and downwardly from an upper end of the valve guide 16 along a stem 2 of a valve 1 so as to form a clearance between the valve guide 16 and the stem 2 of the valve 1.

The recess 18 on the valve guide 16 is positioned with its lower end being lower than a thinnest portion of the valve guide 16 and at a position not adversely affecting performance of the valve guide 16 so as not to weaken the supporting of the stem 2 of the valve 1 and restriction on the moving directions of the valve 1.

As shown in FIG. 5, the recess 18 on the valve guide 16 may alternatively have a shape extending downwardly from the upper end of the valve guide 16 along the stem 2 of the valve 1 and having a taper 19 adjacent to its lower end and with reduced inner diameter toward the lower end. Further, as shown in FIG. 6, it may alternatively have a shape extending downwardly from the upper end of the valve guide 16 along the stem 2 of the valve 1 and having a taper 20 with reduced inner diameter from its upper end toward its lower end. Still further, it may alternatively a different shape having a taper (not shown) with reduced inner diameter toward its lower end and with a predetermined bent.

Workings of the embodiments according to the invention will be described.

When radial stress is applied on the upper portion of the stem 2 of the valve 1, load working point P is generated on the lower end of the recess 16 on the valve guide 16, the load on the valve guide 16 being positioned at a position lower than the thinnest portion of the valve guide 16 where the engagement groove 10 is formed.

Thus, the recess 18 is formed on the inner peripheral surface 17 of the valve guide 16 to provide the clearance between the valve guide and the stem of the valve, so that, even if radial stress is applied on the stem 2 of the valve 1, the load working point p generated on the valve guide 16 can be positioned at the lower end of the recess 18 and an annular portion of the valve guide 16 above the load working point can provide a reinforcing member, thereby suppressing deterioration of the valve guide 16 especially at the load working point P. The load generated on the valve guide 16 also becomes load on the stem 2 of the valve 1, which causes no deterioration of the stem 2 of the valve 1 because of shape and quality of material of the stem 2 of the valve 1.

When the recess 18 on the valve guide is formed with its lower end being lower in position than the thinnest portion of the valve guide 16, the load working point P is generated at a position lower than the thinnest portion of the valve guide 16, which can prevent the load from acting on the thinnest portion of the valve guide 16 and favorably suppress the deterioration of the valve guide 16.

When the engagement groove 10 is formed on the outer periphery of the valve guide 16 so as to engage with the stem steal 11 for prevention of intrusion of oil and the recess 18 on the valve guide is formed with its lower end being lower in position than the engagement groove 10, then the load working point P is generated at a position lower than the engagement groove 10, which can prevent the load from acting on the engagement groove 10 and favorably suppress the deterioration of the valve guide 16.

When the recess 18 has the taper 19 or 20 with the reduced inner diameter toward its lower end, the load generated on the valve guide 16 is relieved by the taper, which can further favorably suppress the deterioration of the valve guide 16.

It is to be understood that a valve guide structure according to the invention is not limited to the above-mentioned embodiments and that various changes and modifications may be made without departing from the scope of the invention.

The invention claimed is:

1. A valve guide structure for supporting a stem of a valve by an inner peripheral surface of a valve guide so as to restrict moving directions of the valve, comprising:

a recess on the inner peripheral surface of the valve guide, said recess extending downwardly from an upper end of the valve guide along the stem of the valve so as to form a clearance between the valve guide and the stem of the valve, and an engagement groove formed on an outer periphery of the valve guide for engagement with a stem seal to prevent intrusion of oil, the recess on the valve guide having a lower end lower in position than a thinnest portion of the valve guide, the thinnest portion of the valve guide corresponding to a location of the engagement groove such that the thinnest portion and the engagement groove have a same position relative to an axial direction defined by an axis of the valve guide.

2. The valve structure according to claim 1, wherein the recess has a taper with reduced inner diameter toward a lower end thereof.

3. The valve guide structure according to claim 2, wherein the recess includes an untapered section between the taper and the upper end.

4. The valve guide structure according to claim 3, wherein the untapered section has a same position in the axial direction as the engagement groove.

* * * * *